US011462837B2

(12) United States Patent
Kuwabara

(10) Patent No.: US 11,462,837 B2
(45) Date of Patent: Oct. 4, 2022

(54) ARRAY ANTENNA

(71) Applicant: NEC Corporation, Tokyo (JP)

(72) Inventor: Toshihide Kuwabara, Tokyo (JP)

(73) Assignee: NEC CORPORATION, Tokyo (JP)

( * ) Notice: Subject to any disclaimer, the term of this patent is extended or adjusted under 35 U.S.C. 154(b) by 193 days.

(21) Appl. No.: 16/979,447

(22) PCT Filed: Feb. 15, 2019

(86) PCT No.: PCT/JP2019/005696
§ 371 (c)(1),
(2) Date: Sep. 9, 2020

(87) PCT Pub. No.: WO2019/187758
PCT Pub. Date: Oct. 3, 2019

(65) Prior Publication Data

US 2021/0005981 A1 Jan. 7, 2021

(30) Foreign Application Priority Data

Mar. 29, 2018 (JP) ..... JP2018-065633

(51) Int. Cl.

| | |
|---|---|
| ***H01Q 21/06*** | (2006.01) |
| ***H01Q 1/38*** | (2006.01) |
| ***H01Q 3/36*** | (2006.01) |
| ***H01Q 21/00*** | (2006.01) |

(52) U.S. Cl.
CPC ..... *H01Q 21/064* (2013.01); *H01Q 1/38* (2013.01); *H01Q 3/36* (2013.01); *H01Q 21/0037* (2013.01); *H01Q 21/065* (2013.01)

(58) Field of Classification Search
CPC ..... H01Q 21/06; H01Q 1/38; H01Q 3/36; H01Q 21/00
See application file for complete search history.

(56) References Cited

U.S. PATENT DOCUMENTS

| | | | | |
|---|---|---|---|---|
| 5,426,441 | A | 6/1995 | Kapitsyn et al. | |
| 2006/0256016 | A1* | 11/2006 | Wu | H01Q 21/065 343/700 MS |
| 2016/0218438 | A1* | 7/2016 | Miraftab | H01Q 9/045 |

FOREIGN PATENT DOCUMENTS

| | | | |
|---|---|---|---|
| JP | 04-258003 | A | 9/1992 |
| JP | 2000-196331 | A | 7/2000 |
| JP | 2005-102024 | A | 4/2005 |
| JP | 2005-341443 | A | 12/2005 |

OTHER PUBLICATIONS

International Search Report [PCT/ISA/210] of PCT/JP2019/005696 dated Mar. 12, 2019.

* cited by examiner

*Primary Examiner* — Andrea Lindgren Baltzell
(74) *Attorney, Agent, or Firm* — Sughrue Mion, PLLC

(57) ABSTRACT

A waveguide branch circuit includes a waveguide, and branches a signal input from an external port into two or more signals. A microstrip line branch circuit includes a microstrip line, and further branches the signal branched by the waveguide branch circuit into two or more signals. A converter converts a signal between the waveguide and the microstrip line. The signals branched by the microstrip line are respectively input to a plurality of antenna elements.

8 Claims, 6 Drawing Sheets

ARRAY ANTENNA

CROSS REFERENCE TO RELATED APPLICATIONS

This application is a National Stage of International Application No. PCT/JP2019/005696 filed Feb. 15, 2019, claiming priority based on Japanese Patent Application No. 2018-065633 filed Mar. 29, 2018, the entire disclosure of which is incorporated herein.

TECHNICAL FIELD

The present disclosure relates to an array antenna, and more particularly to an array antenna having a plurality of antenna elements.

BACKGROUND ART

An array antenna having a plurality of antenna elements is known. In relation to an array antenna, Patent Literature 1 discloses a phased array antenna used for transmitting and receiving high frequency signals such as microwaves and millimeter waves. The phased array antenna has a phase shifter for controlling the phase of high frequency signals transmitted and received by each antenna element. The phase of the high frequency signals transmitted and received by each antenna element is controlled, whereby electronic scanning of the radio wave beam becomes possible.

FIGS. 7 and 8 show a phased array antenna similar to that disclosed in Patent Literature 1. The phased array antenna 200 has a plurality of antenna elements 201 arranged vertically and horizontally in two dimensions on the surface of a substrate 210 (See FIG. 7). Further, the phased array antenna 200 also has integrated circuits (core chips) 202 each made of a semiconductor or the like on the rear surface side of the substrate 210 (See FIG. 8). The integrated circuit configuring the core chip 202 includes at least a phase shifter. The integrated circuit includes an IC (integrated circuit) or the like, and a circuit configured as a general electrical circuit or an electronic circuit.

Microstrip lines 203 are formed on the back side of the substrate 210. The microstrip lines 203 constitute an interface between the antenna and the external device, and a divider/combiner circuit for high frequency signals. In the example of FIG. 8, the microstrip lines 203 branch the high frequency signal input from the interface during transmission into 16 core chips 202. Each core chip 202 includes phase shifters corresponding to the four antenna elements 201, and outputs phase controlled high frequency signals to the corresponding antenna elements 201.

Another example of an array antenna is disclosed in Patent Literature 2. Patent Literature 2 discloses an antenna back plate in which an active electronic module is incorporated. The antenna back plate disclosed in Patent Literature 2 has a plurality of layers that form a monolithic structure configured to provide EHF (Extra High Frequency) signal distribution for an active sub-array module and heat dissipation control and provide structural rigidity.

The plurality of layers of the antenna back plate include a first layer to a fourth layer. The first layer includes a high density multi-chip interconnect layer for distributing control logic signals and the like. The second layer includes a metal matrix composite motherboard for providing structural rigidity and thermal conductivity. The third layer has an integrated waveguide, a resonant cavity, and a cooling structure for simultaneously performs EHF signal distribution and air cooling. The fourth layer includes a metal matrix composite back plate that is a bottom cover of the array back plate.

CITATION LIST

Patent Literature

[Patent Literature 1] Japanese Unexamined Patent Application Publication No. 2000-196331
[Patent Literature 2] Japanese Unexamined Patent Application Publication No. H04-258003

SUMMARY OF INVENTION

Technical Problem

In 5G (5th Generation), which will be the next generation mobile communication system, the technology of the phased array antenna in millimeter waves is essential. In recent years, a relatively thin and inexpensive phased array antenna has been realized by combining the above mentioned core chips with the printed circuit board patch array antenna. Core chips are already a reality as shown in academic reports (2017 IEEE ISSCC, "A 28 GHz 32-Element Phased-Array Transceiver IC with Concurrent Dual Polarized Beams and 1.4 Degree Beam-Steering Resolution for 5G Communication") and in actual product releases (AWMF-0108 manufactured by Anokiwave, etc.).

As shown in FIG. 8, in the phased array antenna 200, it is necessary to form a large number of branches in the microstrip lines 203 in order to connect an interface with the outside and each core chip 202. For example, a high frequency signal input from the outside needs to pass through many branches before being input to the core chip 202, and attenuation occurs in the signal at every branch. The amount of the attenuation increases with the number of branches, and, for example, in the millimeter or microwave band, the attenuation of the signal at the substrate can be significant.

Although only the core chips 202 and the high frequency lines (microstrip lines 203) for distributing the high frequency signals are shown in FIG. 8, in the reality, bypass capacitors or the like are arranged around the core chips 210 on the substrate 202. Further, in addition to the high frequency lines, lines for supplying power and signal lines for controlling the elements are arranged on the substrate 210. If the microstrip lines 203 including a large number of branches are arranged so as to spread over the entire substrate, it becomes difficult to secure a mounting area for the above components and wires.

To solve the above problem, Patent Literature 1 adopts a multilayer structure in which the microstrip lines 203 and the core chips 202 are arranged in different layers. More specifically, the microstrip lines 203 are formed in the dividing/combining layer, and the core chips 202 are arranged in the phase control layer, and the dividing/combining layer and the phase control layer are connected to each other via a coupling layer. With this configuration, the area occupied by the microstrip lines of the distribution coupling layer on the phase control layer can be reduced, and thus the mounting area can be easily secured.

However, in Patent Literature 1, there is a problem that the attenuation of a signal is large when the number of branches is large. Patent Literature 1 discloses that, regarding each of the strip lines, a distributed constant line such as a triplate type, a coplanar type, and a slot type can be used in addition to a microstrip type. However, even when these distributed constant lines are used, signal attenuation cannot be reduced in a high frequency band such as a millimeter wave, and thus Patent Literature 1 does not provide a solution to the problem that signal attenuation is large when the number of branches is large.

On the other hand, in Patent Literature 2, high frequency signals are distributed by using a waveguide included in the third layer, and thus signals can be branched with low loss as compared with the case where microstrip lines are used. However, in the case of high frequency signals such as millimeter waves, the spacing between the antenna elements is not sufficiently wide compared with the size required for the waveguide. Therefore, it is not practical to directly feed the antenna element from the waveguide.

In view of the above circumstances, one of objects of the present disclosure is to provide an array antenna capable of feeding antenna elements with low loss even when a plurality of antenna elements are arranged at narrow intervals.

Solution to Problem

In order to solve the aforementioned problems, the present disclosure provides an array antenna including: a waveguide branch circuit including a waveguide, and branching a signal input from an external port into two or more signals; a microstrip line branch circuit including a microstrip line, and further branching the signal branched by the waveguide branch circuit into two or more signals; converting means for converting a signal between the waveguide and the microstrip line; a plurality of antenna elements to which the signals branched by the microstrip line are respectively input.

Advantageous Effects of Invention

The array antenna according to the present disclosure is capable of feeding antenna elements with low loss even when a plurality of antenna elements are arranged at a narrow intervals.

DESCRIPTION OF EMBODIMENTS

Figure 1:
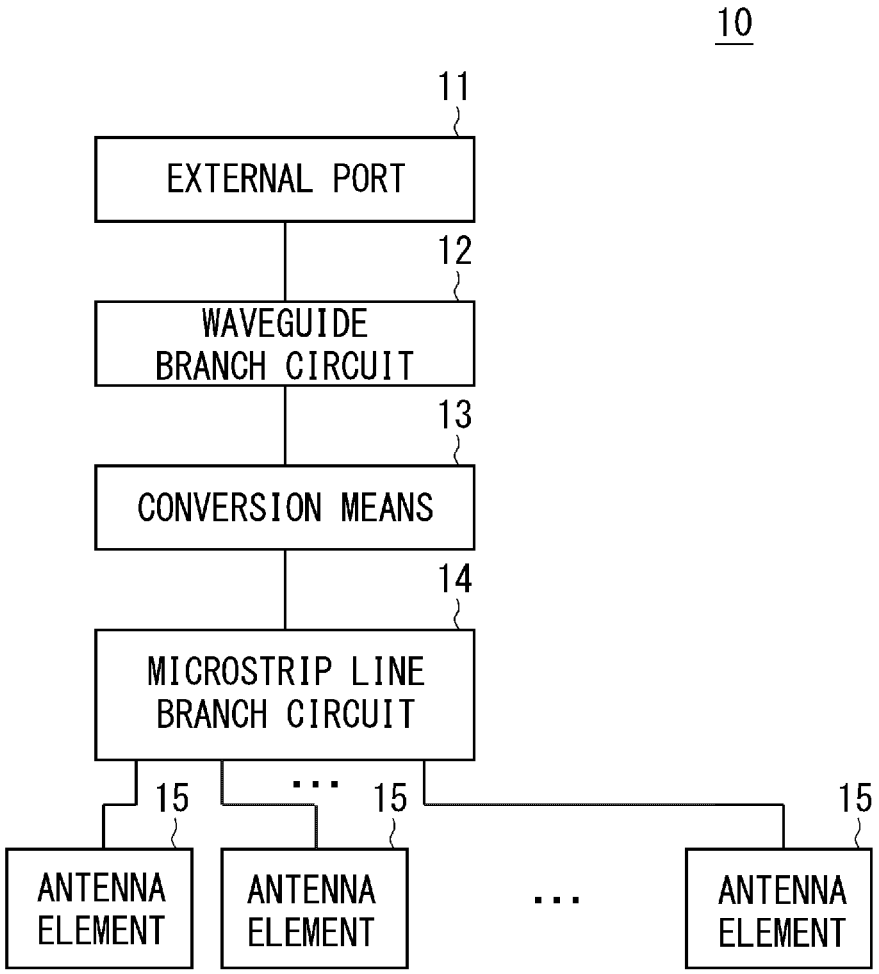
FIG. 1 is a block diagram illustrating a schematic array antenna of the present disclosure.

Prior to describe exemplary embodiments, an outline of the present disclosure will be described. FIG. 1 shows a schematic array antenna of the present disclosure. An array antenna 10 includes a waveguide branch circuit 12, a conversion means 13, a microstrip line branch circuit 14, and a plurality of antenna elements 15.

The waveguide branch circuit 12 includes a waveguide and branches signals input from an external port 11 into 2 or more signals. The microstrip line branch circuit 14 includes a microstrip line and further branches the signals branched by the waveguide branch circuit 12 into 2 or more signals. The conversion means 13 performs signal conversion between the waveguide of the waveguide branch circuit 12 and the microstrip line of the microstrip line branch circuit 14. The signals branched by microstrip line are input to each of the plurality of antenna elements 15.

At the time of signal transmission, signals (electromagnetic waves) input from the external port 11 is branched into 2 or more signals by the waveguide branching circuit 12, and converted from electromagnetic waves into signals on microstrip lines by the conversion means 13. The converted signals are further branched by the microstrip line branch circuit 14 and is fed to each of the plurality of antenna elements 15.

In the present disclosure, the waveguide branch circuit 12 and the microstrip line branch circuit 14 are used for branching signals input from the external port. By further branching the signals branched by the waveguide by the microstrip line, attenuation of the signals can be reduced as compared with the case where all the branching is done in the microstrip lines. Further, when all the branching is done in the waveguide, in a case where the intervals between the antenna elements 15 are narrow, the size of the waveguide is not sufficiently small with respect to the intervals between the antenna elements 15, and feeding may become difficult. When the size of the waveguide is reduced in accordance with the intervals of the antenna elements 15, loss increases in the waveguide. According to the present disclosure, the antenna element 15 is fed from the microstrip line, and thus it is possible to feed the antenna element 15 with low loss even when the intervals between the antenna elements 15 are narrow.

Although the array antenna 10 has been described mainly using a signal flow at the time of signal transmission, the array antenna 10 may be used for receiving signals instead of or in addition to transmitting signals. At the time of signal reception, the signals received by the plurality of antenna elements 15 are combined by the microstrip line branch circuit 14, and then converted from the signals on the microstrip lines to the signals of the waveguide by the conversion means 13. The converted signals are further combined by the waveguide branch circuit 12 and output from the external port 11.

Figure 2:
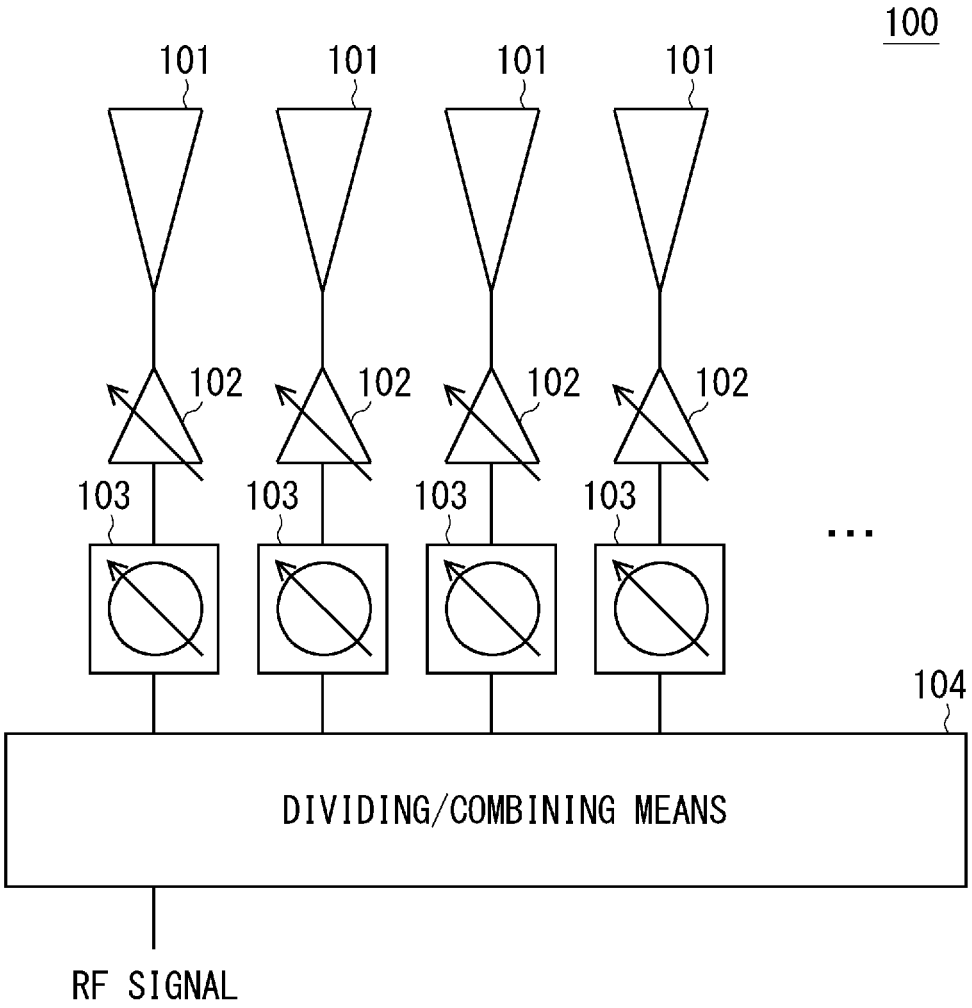
FIG. 2 is a block diagram illustrating an array antenna according to an embodiment of the present disclosure.

Hereinafter, embodiments of the present disclosure will be described in detail with reference to the drawings. FIG. 2 shows an array antenna according to an embodiment of the present disclosure. In the present embodiment, the array antenna is configured as a phased array antenna 100. The phased array antenna 100 includes a plurality of antenna elements 101, a plurality of amplifiers 102, a plurality of phase shifters 103, and a dividing/combining means 104. The antenna element 101 corresponds to the antenna element 15 shown in FIG. 1. The dividing/combining means 104 includes the waveguide branch circuit 12, the conversion means 13, and the microstrip line branch circuit 14 shown in FIG. 1.

The dividing/combining means 104 has an external port (interface), and RF (Radio Frequency) signals are input to the dividing/combining means 104 from the external port. The dividing/combining means 104 branches the input RF signal, for example, by the number of the plurality of antenna elements 101. Alternatively, when the plurality of amplifiers 102 and the phase shifters 103 are formed in one IC, the dividing/combining means 104 may branch the RF signal by the number of ICs used and input the RF signal to each IC. The RF signal is a high frequency signal such as, for example, a millimeter wave.

The phased array antenna 100 has a plurality of sets of the antenna element 101, the amplifier 102, and the phase shifter 103. To the phase shifter 103, the RF signal branched by the dividing/combining means 104 is input. The phase shifter 103 is configured to change the phase of the input RF signal. The phase shifter 103 controls the phase of the RF signal based on a control signal received from a control unit (not shown). The amplifier 102 amplifies the RF signal whose phase is controlled by the phase shifter 103. The amplifier 102 controls the amplitude of the RF signal based on a control signal received from a control unit (not shown). The RF signal amplified by the amplifier 102 is transmitted from the antenna element 101. By controlling the phase controlled by each phase shifter 103, the beam direction of the RF signal transmitted from the plurality of antenna elements 101 can be controlled.

It should be noted that the amplifier 102 is used to amplify transmission signals in the phased array antenna 100. The phased array antenna 100 may include an amplifier for amplifying reception signals received by antenna element 101 in place of or in addition to the amplifier 102. When the phased array antenna 100 has the amplifier 102 for transmission signals and the amplifier for reception signals, a transmission/reception switching switch for selectively connecting either one of the amplifiers to the phase shifter 103 may be provided. The reception signals received by each antenna element 101 are amplified by the amplifier for reception signals, and then the phase is controlled by each phase shifter 103. The reception signals whose phases are controlled by the phase shifters 103 are combined by the dividing/combining means 104 and output from the external port. Hereinafter, a case where the phased array antenna 100 is mainly used as a transmission antenna will be described.

Figure 3:
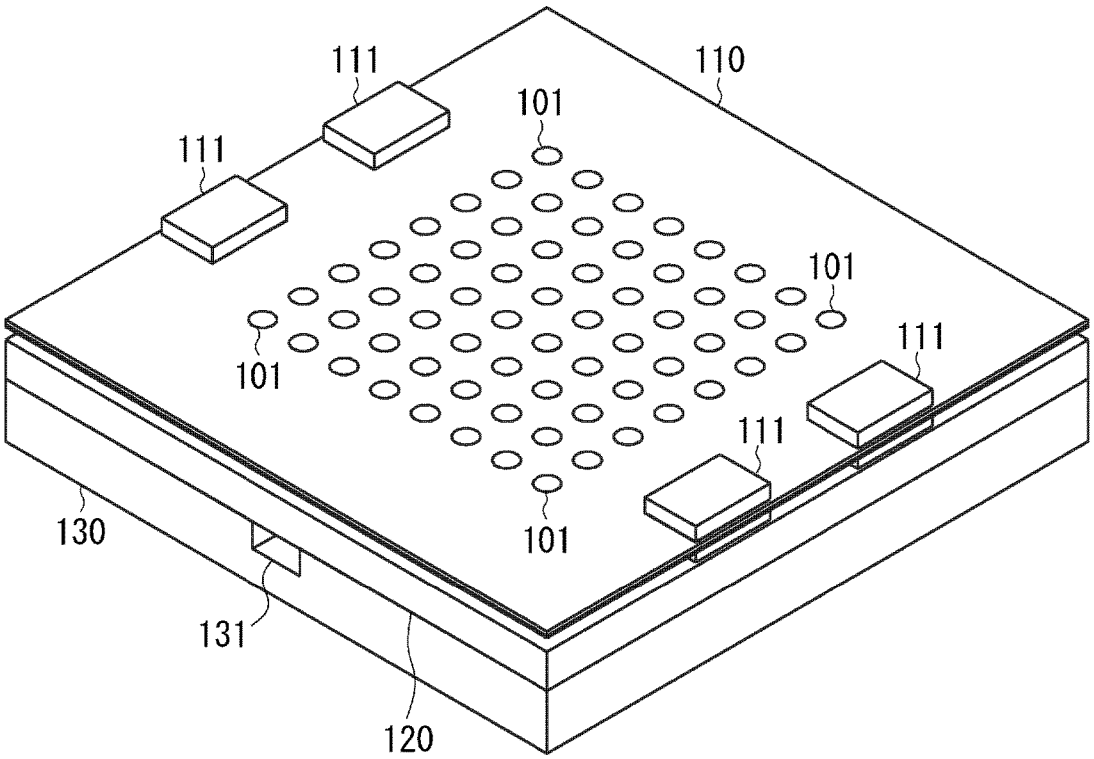
FIG. 3 is a perspective view illustrating an exemplary configuration of the phased array antenna.
Figure 4:
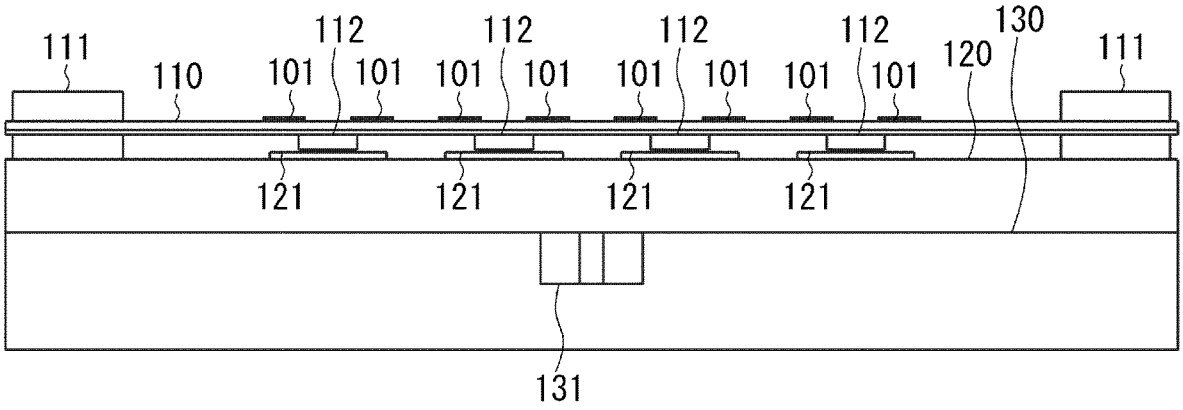
FIG. 4 is a side view illustrating an exemplary configuration of the phased array antenna.
Figure 5:
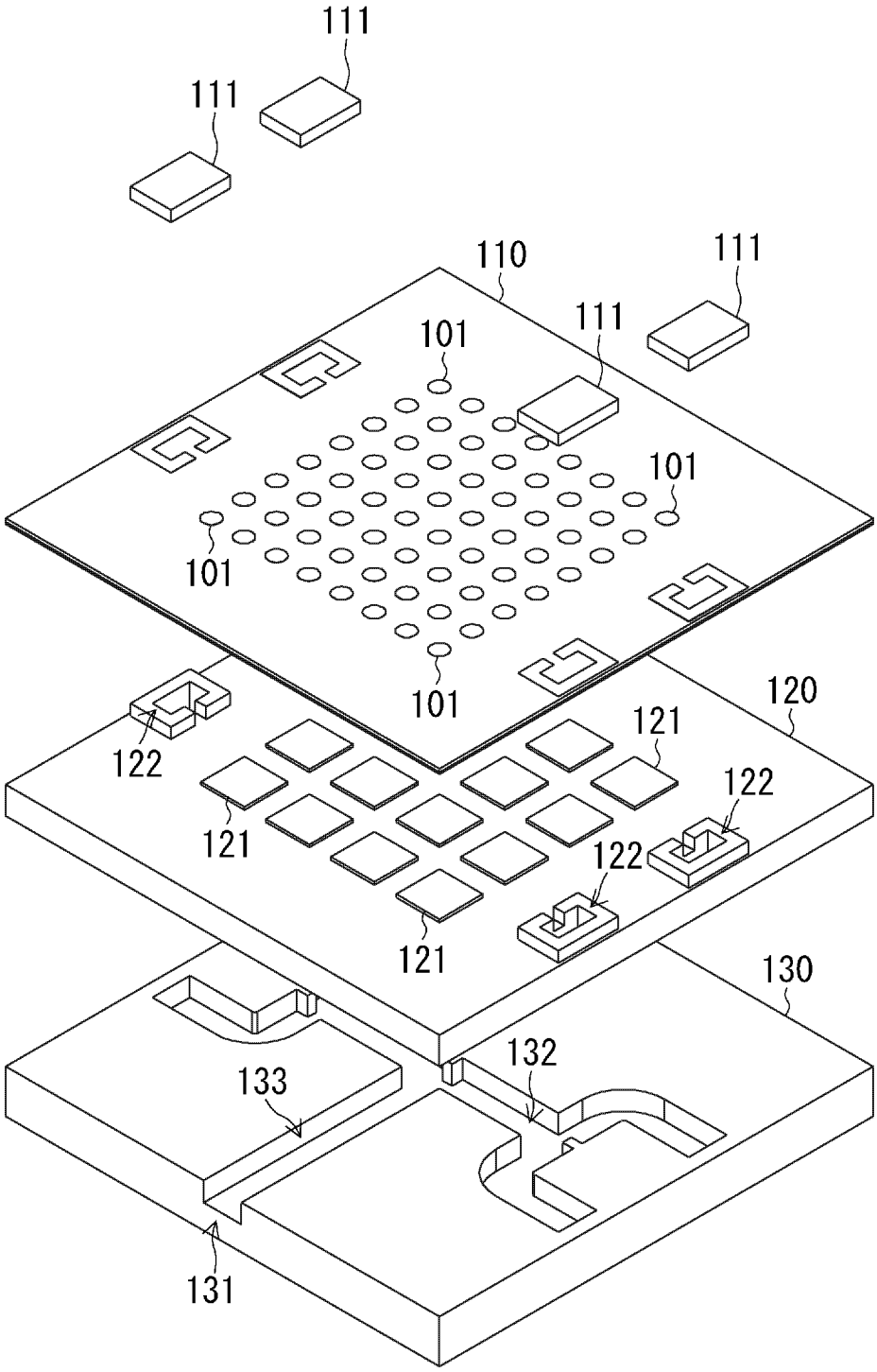
FIG. 5 is an exploded perspective view illustrating an exemplary configuration of the phased array antenna.
Figure 6:
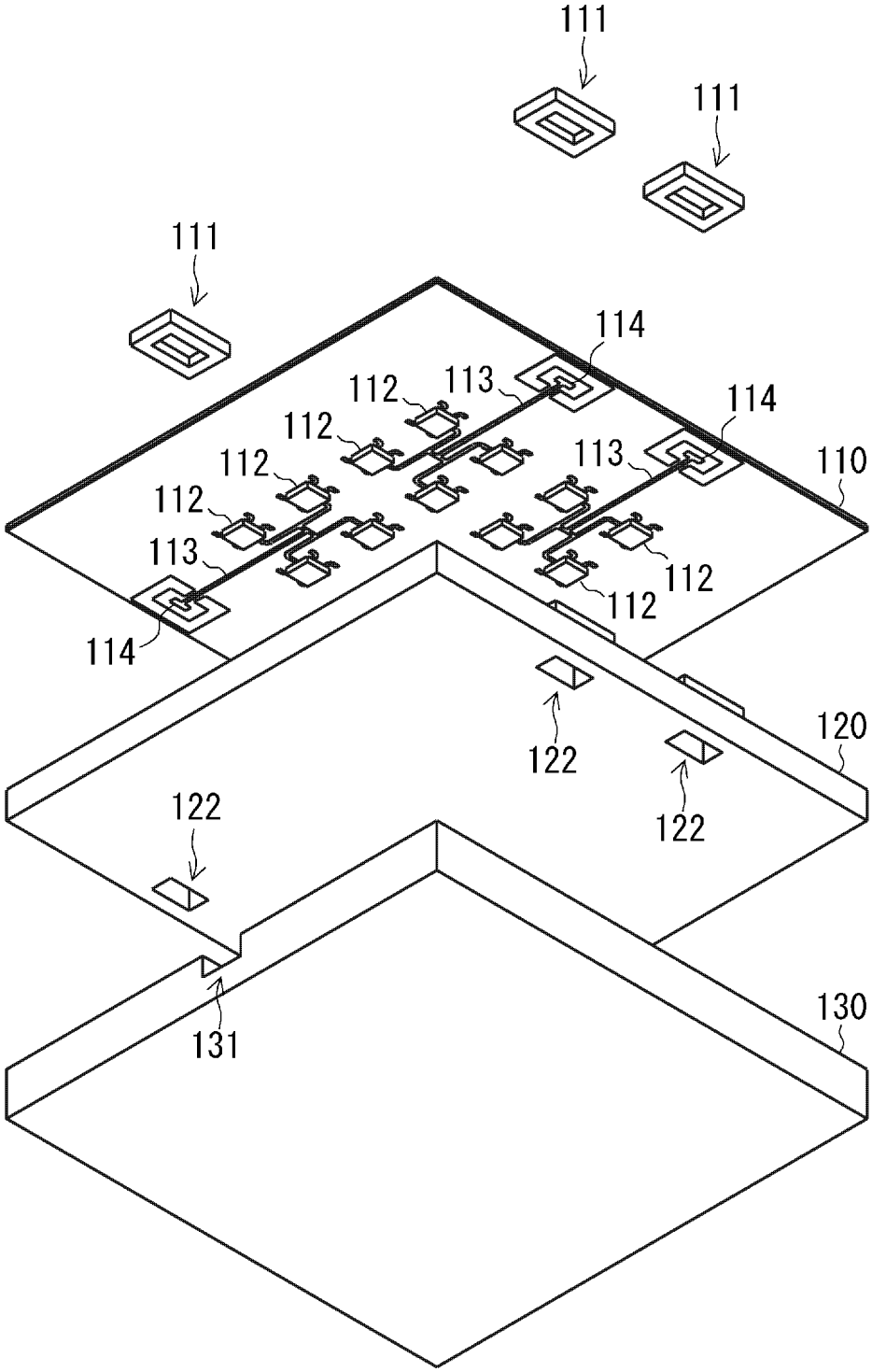
FIG. 6 is an exploded perspective view illustrating an exemplary configuration of the phased array antenna.
Figure 7:
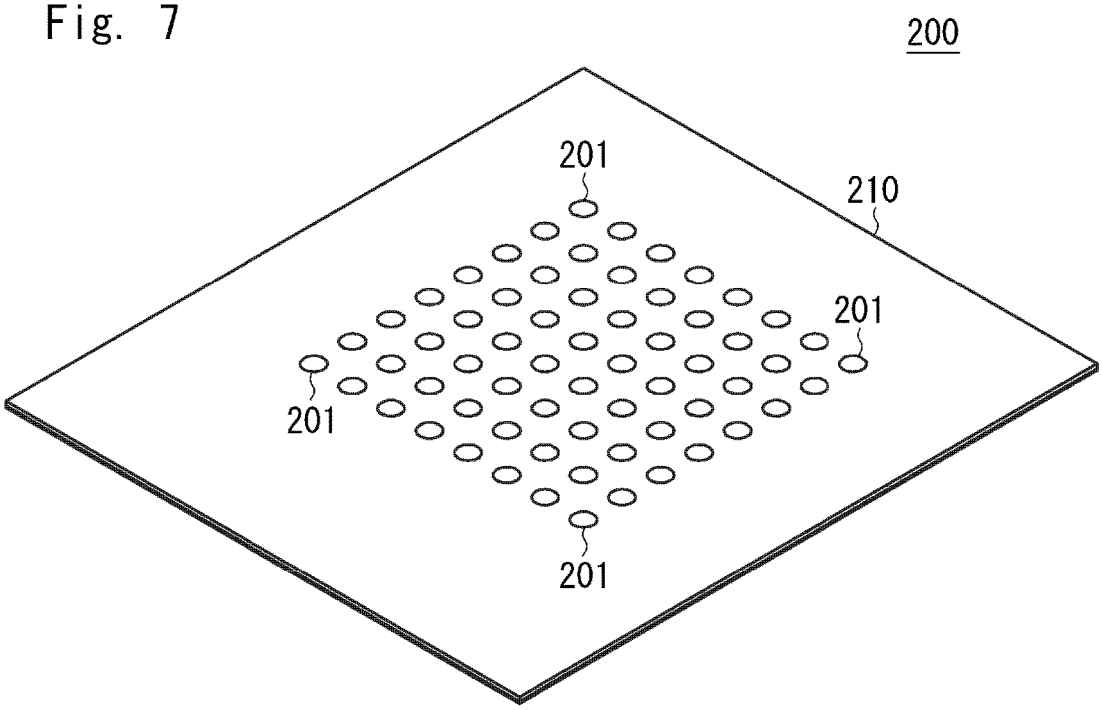
FIG. 7 is a perspective view illustrating a phased array antenna similar to that disclosed in Patent Literature 1.
Figure 8:
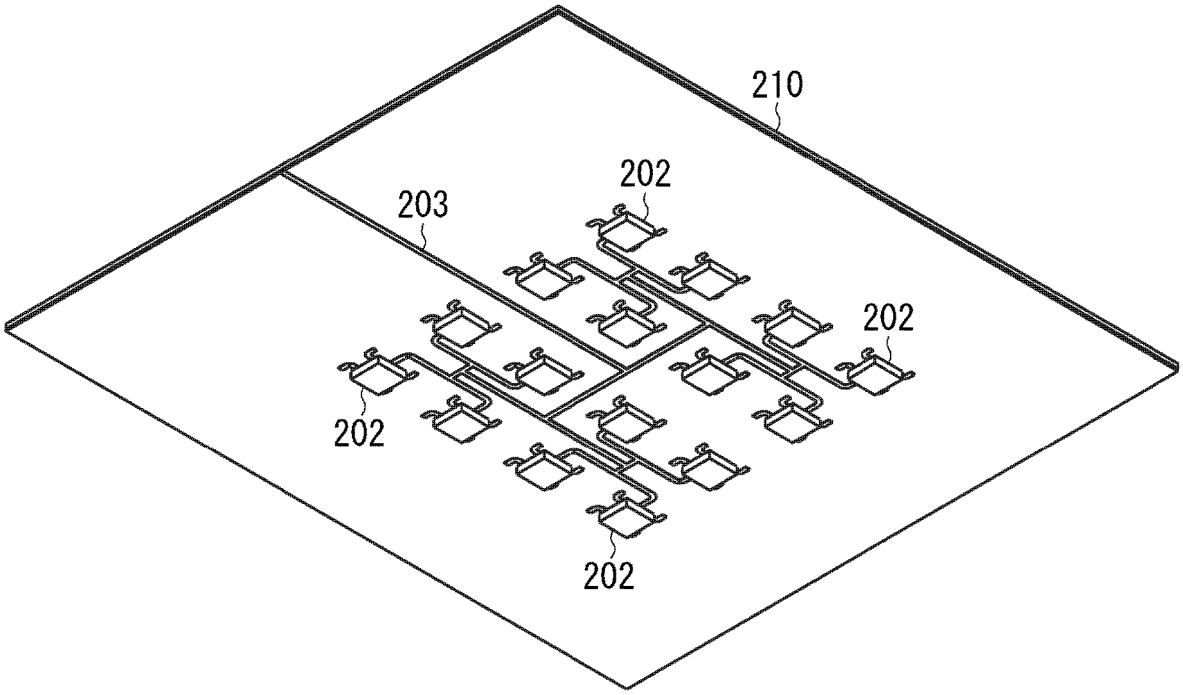
FIG. 8 is a perspective view showing a phased array antenna similar to that disclosed in Patent Literature 1.

FIGS. 3 to 6 show a configuration example of the phased array antenna 100. FIG. 3 is a perspective view of the phased array antenna 100 as viewed from the antenna element 101 side. FIG. 4 is a side view of the phased array antenna 100. FIG. 5 is an exploded perspective view of the phased array antenna 100 as viewed from the antenna element 101 side, and FIG. 6 is an exploded perspective view of the phased array antenna 100 as viewed from the rear side. In this example, the phased array antenna 100 includes a substrate 110 and metal blocks 120 and 130.

As shown in FIGS. 3 and 5, patch antenna elements, which are antenna elements 101, are arranged in a matrix on the substrate 110. The plurality of antenna elements 101 are arranged, for example, at intervals of $\lambda/2$ with an RF signal as $\lambda$. In FIGS. 3 and 5, a total of 64 antenna elements 101 are arranged on the substrate 110. Further, 4 metal parts 111 constituting the short-circuited end (back short) of the terminal short-circuited waveguide are arranged on the substrate 110. In FIGS. 3 and 5, the shape of the antenna element 101 is circular (circular patch), but the present invention is not limited thereto. The antenna element 101 may be configured as a rectangular patch, a waveguide horn, or a slot antenna.

As shown in FIG. 5, the metal block 130 is formed with a groove 132. The groove 132 has a width, for example, on the order of $\lambda/2$ to $\lambda$. The metal block 130 is stacked with the metal block 120 (See also FIG. 6) whose back side surface is flat, and the groove 132 constitutes a rectangular waveguide. An external port 131, which is an end of the groove (waveguide) 132, constitutes an interface to which an external device such as a wireless transceiver is connected. The RF signal is input/output from the external port 131. The waveguide 132 constitutes the waveguide branch circuit 12 shown in FIG. 1.

In the example of FIG. 5, the waveguide branches the RF signal input from the external port 131 by 4. A filter may be formed in the waveguide portion 133 between the external port 131 and the first branch of the waveguide 132. The number of branches in the waveguide 132 is not limited to "4", and the waveguide 132 may branch the RF signal by any number. The RF signals branched into 4 signals propagate to the substrate 110 through waveguides configured by a hole part 122 (See also FIG. 6) formed in the metal block 120 and the metal part 111, respectively.

As shown in FIGS. 4 and 6, on the surface (rear surface) of the substrate 110 opposite to the surface on which the antenna elements 101 are disposed, a plurality of core chips (integrated circuits) 112 and a plurality of microstrip lines 113 are arranged. Each core chip 112 is arranged so as to correspond to a predetermined number of antenna elements 101. Each core chip 112 is arranged so as to correspond to, for example, 4 antenna elements 101, and 16 core chips are arranged on the rear surface side of the substrate 110. Each core chip 112 is configured to independently control the phase of the RF signals output to the corresponding 4 antenna elements 101. Specifically, each core chip 112 includes 4 amplifiers 102 and 4 phase shifters 103 shown in FIG. 2. Each core chip 112 may include any number of phase shifters, and the number of phase shifters is not limited to 4.

As shown in FIG. 6, the plurality of microstrip lines 113 are arranged on the rear surface of the substrate 110. The microstrip lines 113 are formed so as to correspond to each of the signals branched by the waveguide 132. For example, when the number of branches of the waveguide 132 is 4, 4 microstrip lines 113 are formed on the rear surface of the substrate 110. Each of the microstrip lines 113 is configured as for example, a 4-branch circuit, and branches a signal to 4 core chips 112. The microstrip lines 113 correspond to microstrip line branch circuit 14 shown in FIG. 1.

Each of the microstrip lines 113 includes a probe part 114 protruding to a waveguide configured by the hole part 122 of the metal block 120 and the metal part 111. In the present embodiment, the converting means 13 shown in FIG. 1 is configured by using the probe part 114 of the general microstrip line 113 having an open end and the metal part 111 constituting a back short of a waveguide. The method for signal conversion between the waveguide and the microstrip line on the substrate is not particularly limited, and other method may be used for the conversion.

As shown in FIGS. 4 and 5, the metal block 120 has a plurality of protruding parts 121 protruding toward the substrate 110 on the surface facing the substrate 110. The metal block 120 has the protruding parts 121 at positions corresponding to each core chip 112. For example, the protruding parts 121, the number of which is the same as the number of core chips 112, are formed on the metal block 120. The protruding parts 121 and the core chips 112 are adhered to each other through, for example, a silicon-based adhesive. In this case, the core chip 112 is thermally coupled to the metal block 120, and the heat of the core chip 112 is dissipated through the metal blocks 120 and 130.

The RF signal input from the external port 131 is branched into 4 signals while traveling through a waveguide configured by the metal blocks 120 and 130. Each of the branched RF signals is converted by the probe part 114 into a signal on the microstrip lines 113 on the substrate 110, and further branched into 4 signals by the microstrip lines 113.

In this way, each of the branched RF signals can be supplied to each of the total 16 core chips 112. Each core chip 112 controls the phase and amplitude of a signal to be fed to each of the corresponding 4 antenna elements 101, and each antenna element 101 transmits an RF signal whose phase and amplitude are controlled.

In the present embodiment, the waveguide 132 is used for the interface between the phased array antenna 100 and the external transceiver, and the RF signal input at the time of transmission is branched through a waveguide branch circuit configured by using the waveguide 132. The waveguide 132 is connected to the substrate 110 at each branched end thereof, and the branched RF signals are converted into signals on the microstrip lines 113 at a plurality of points of the substrate 110. The converted RF signals are further branched in the microstrip lines 113 and input to the core chips 112, respectively. The core chip 112 controls the phase and amplitude of the input RF signal, and causes the antenna element 101 to transmit the RF signal whose phase and amplitude are controlled.

In the present embodiment, the signal branched using the waveguide 132 is input to the microstrip lines 113. In this case, the number of branches in the microstrip lines 113 can be reduced and the wiring length can be shortened as compared with the case where all the branching is done in the microstrip lines 113. In this manner, attenuation of the signal in the branch circuit configured using the microstrip lines 113 on the substrate 110 can be reduced. The signal attenuation amount of the waveguide 132 is lower than that of the microstrip lines 113, and the total signal attenuation amount can be reduced by shortening the wiring length of the microstrip lines 113.

Further, in the present embodiment, the waveguide 132 is configured by using the metal blocks 120 and 130, and the metal blocks 120 and 130 in which the waveguide 132 is formed and the substrate 110 are stacked. In the present embodiment, since not all the branching is done on the substrate 110, the area of the region on the substrate 110 where the microstrip lines 113 are formed can be reduced as compared with the case where all the branching is done on the substrate 110. In this way, it is possible to expand an area in which components and wires for power supply and control can be arranged in the substrate 110.

Further, in the present embodiment, devices on the substrate 110 such as the core chips 112 are thermally coupled to the metal block 120 in which the waveguide branch circuit is formed. Thus, the heat generated by the devices can be transferred to the metal block 120, and the temperature of the devices can be lowered. According to the present embodiment, since the metal blocks 120 and 130 in which the waveguide 132 is formed also serve as a heat dissipation structure, heat dissipation can be easily performed without any additional structure.

Further, in the present embodiment, a filter circuit required by the communication device can be relatively easily formed in the waveguide portion 133 between the external port 131 and the first branch point of the waveguide 132. When the filter is formed in the waveguide portion 133, it is not necessary to separately arrange the filter, and the constitution of the device is simplified.

It should be noted that, although an example is explained in the above embodiment where the array antenna is configured as a phased array antenna, the present invention is not limited thereto. In an array antenna, the core chip 112 that controls the phase and amplitude of the RF signal is not necessarily required. For example, the array antenna may be configured such that the microstrip line 113 and the antenna element 101 are connected to each other without a phase shifter or the like.

In FIG. 5, an example has been described in which the grooves 132 constituting the waveguides are formed in the metal block 130. However, the present invention is not limited thereto. The grooves constituting the waveguides may be formed in the metal block 120, not in the metal block 130. When the grooves constituting the waveguides are formed in the metal block 120, the metal block 130 may have a flat surface on the side of the metal block 120. The waveguide (waveguide branch circuit) need not necessarily be formed in a metal block. The waveguide may be surrounded by a conductor such as a metal, and may be formed by a material in which, for example, a conductor film such as a metal is formed on the surface of a dielectric.

In FIG. 2, an example is shown in which the amplifier 102 and the phase shifter 103 are arranged so as to correspond to each antenna element 101. However, the present invention is not limited thereto. The plurality of antenna elements 101 may be grouped by a predetermined number, and the amplifier 102 and the phase shifter 103 may be arranged for each group. When the amplifier 102 and the phase shifter 103 are arranged so as to correspond to each antenna element 101, the phase and amplitude of the RF signal to be transmitted can be controlled for each antenna element 101. When the amplifier 102 and the phase shifter 103 are arranged so as to correspond to a predetermined number of antenna elements 101, the phase and amplitude of the RF signal to be transmitted can be controlled for each of the grouped predetermined number of antenna elements 101.

While the present disclosure has been described with reference to the example embodiments, the present disclosure is not limited to the aforementioned example embodiments. Various changes that can be understood by those skilled in the art can be made to the configurations and the details of the present disclosure within the scope of the present disclosure.

REFERENCE SIGNS LIST

10 ARRAY ANTENNA
11 EXTERNAL PORT
12 WAVEGUIDE BRANCH CIRCUIT
13 CONVERSION MEANS
14 MICROSTRIP LINE BRANCH CIRCUIT
15 ANTENNA ELEMENT
100 PHASED ARRAY ANTENNA
101 ANTENNA ELEMENT
102 AMPLIFIER
103 PHASE SHIFTER
104 DIVIDING/COMBINING MEANS
110 SUBSTRATE
111 METAL PART
112 CORE CHIP
113 MICROSTRIP LINE
114 PROBE PART
120 METAL BLOCK
121 PROTRUDING PART
122 HOLE PART
130 METAL BLOCK
131 EXTERNAL PORT
132 GROOVE (WAVEGUIDE)
133 WAVEGUIDE PORTION

The invention claimed is:

1. An array antenna comprising:

a waveguide branch circuit including a waveguide, and branching a signal input from an external port into two or more signals;

a microstrip line branch circuit including a microstrip line, and further branching the signal branched by the waveguide branch circuit into two or more signals;

a converter configured to convert a signal between the waveguide and the microstrip line;

a plurality of antenna elements to which the signals branched by the microstrip line are respectively input.

2. The array antenna according to claim 1, further comprising a phase shifter between the microstrip line and the antenna element for controlling a phase of the signal.

3. The array antenna according to claim 2, wherein the array antenna is configured as a phased array antenna.

4. The array antenna according to claim 2 or 3, further comprising integrated circuits each arranged so as to correspond to a predetermined number of the antenna elements, wherein each of the integrated circuits includes phase shifters corresponding to each of the predetermined number of the antenna elements.

5. The array antenna according to claim 4, wherein the integrated circuits are thermally coupled to a block in which the waveguide branch circuit is formed, and the heat of the integrated circuits is dissipated through the block.

6. The array antenna according to claim 5, wherein the block has a protruding part protruding toward the integrated circuit, and the integrated circuit and the protruding part are thermally coupled.

7. The array antenna according to claim 1, wherein a filter is formed in the waveguide.

8. The array antenna according to claim 1, wherein the antenna element is a patch antenna element.

* * * * *